US005850799A

United States Patent [19]

Geisel et al.

[11] Patent Number: 5,850,799

[45] Date of Patent: Dec. 22, 1998

[54] PORTABLE BARGE COVER

[75] Inventors: William C. Geisel; Daniel V. Ricciardi; John V. O'Bryant; Kenneth P. Wade, all of Cincinnati, Ohio; David K. Thibodeau, Union, Ky.

[73] Assignee: Midland Enterprises Inc., Cincinnati, Ohio

[21] Appl. No.: 895,121

[22] Filed: Jul. 16, 1997

[51] Int. Cl.[6] ..... B63B 19/14

[52] U.S. Cl. ..... 114/201 R; 114/26; 114/203; 114/361

[58] Field of Search ..... 114/201 R, 203, 114/361, 26; 135/88.01, 88.13, 124

[56] References Cited

U.S. PATENT DOCUMENTS

| | | | |
|---|---|---|---|
| 1,177,625 | 4/1916 | Hopper . | |
| 2,493,833 | 1/1950 | Reynolds | 135/6 |
| 2,542,586 | 2/1951 | Skjeveland | 135/6 |
| 2,864,391 | 7/1958 | Stark | 135/6 |
| 3,226,066 | 12/1965 | Folb | 248/40 |
| 3,354,892 | 11/1967 | Frieder | 135/6 |
| 3,399,687 | 9/1968 | Frieder | 135/6 |
| 3,405,814 | 10/1968 | Yanow | 214/15 |
| 3,604,440 | 9/1971 | Wilson | 135/6 |
| 3,730,128 | 5/1973 | Burwell | 114/201 |
| 3,800,723 | 4/1974 | Collins | 114/201 R |
| 3,861,539 | 1/1975 | Becker, Jr. | 214/14 |
| 4,075,723 | 2/1978 | Bareis et al. | 9/1.5 |
| 4,130,125 | 12/1978 | Nivin | 135/6 |
| 4,237,809 | 12/1980 | Hickmann | 114/202 |
| 4,393,888 | 7/1983 | Nivin | 114/201 R |
| 4,461,232 | 7/1984 | Berg | 114/201 R |
| 4,537,147 | 8/1985 | Nivin | 114/201 R |
| 4,593,641 | 6/1986 | Adams et al. | 114/343 |
| 4,926,782 | 5/1990 | Lacy | 114/361 |
| 4,941,422 | 7/1990 | Muller | 114/203 |
| 4,979,456 | 12/1990 | Steward | 114/351 |
| 4,979,457 | 12/1990 | Sommerhauser et al. | 114/361 |
| 5,070,807 | 12/1991 | Lewis | 114/361 |
| 5,092,262 | 3/1992 | Lacy | 114/361 |
| 5,228,408 | 7/1993 | Jannausch | 114/361 |
| 5,303,667 | 4/1994 | Zirkelbach et al. | 114/361 |
| 5,322,405 | 6/1994 | Swensson et al. | 414/137.4 |
| 5,335,684 | 8/1994 | Hanninen | 135/124 |
| 5,380,058 | 1/1995 | Short et al. | 296/98 |
| 5,632,223 | 5/1997 | Bray et al. | 114/361 |

*Primary Examiner*—Sherman Basinger
*Attorney, Agent, or Firm*—Wood, Herron & Evans, L.L.P.

[57] ABSTRACT

A portable barge cover protects cargo in the hold of a barge from contaminants such as water, snow, dust, bird droppings and the like. The portable barge cover provides a removable and storable covering system that is readily assembled by three or four barge workers. Several overlapping flexible sheets are placed over spaced apart arched members which span from one side of a hold to the opposite side of the hold. The flexible sheets are secured by several straps that cross over the flexible sheets trapping the sheet between the strap and the arched member.

25 Claims, 4 Drawing Sheets

PORTABLE BARGE COVER

FIELD OF THE INVENTION

This invention relates to a portable barge cover, and more specifically to a portable barge cover for protecting the cargo of a hopper barge from weather and other contaminants during storage and transportation.

BACKGROUND OF THE INVENTION

Barges for transporting products such as grain, salt, finished steel or the like typically contain hoppers or holds that are covered to protect the cargo from rain, snow, dust, bird droppings and other contaminants. Barge operators have employed various covering devices. The most common method of covering a barge hold is to place a series of steel or fiberglass covers over the length of the hold. These covers are tailored specifically to meet the exact physical dimensions of the barge hold, rendering them unable to be utilized on barges with different sized holds, especially larger holds. These covers are heavy, cumbersome, and difficult to handle during placement and removal of the covers, which must be lifted individually onto and off the hold. Consequently, the covers are so inefficient to handle by manual labor that automated barge cover handling systems have been developed to ease the burden. These barge cover handling systems are expensive and require the barge to load and unload only where such systems are available.

Recognizing that the steel lift barge covers were expensive and time consuming, barge operators sought alternatives. One alternative, for example, uses steel covers that, instead of being lifted off the barge individually, roll along rails on the barge to telescopically retract. This methodology reduces the man-hours involved in covering and uncovering the cargo. However, the system still requires a specially equipped barge with a series of tracks and wheels along the hold to effectuate the covering and uncovering process. This methodology, while requiring less manpower, still involves the expense of equipping a barge with permanent fixtures that add weight to the barge even when covering of the cargo is not required; and the tracks and wheels require frequent maintenance and repairs. The extra dead weight increases the cost of transporting the cargo because it reduces the cargo carrying capacity of the barge ton for ton.

Still another alternative employs a fabric material that is attached to framing members over the hold and is retractable. This system requires among other things a set of tracks along the side of the hold, with wheels and roller guides. This system has the similar disadvantage as the other method described above; the system is complicated and requires specially fitting the barge with permanent equipment to accommodate the cover deployment mechanism, which is a continual maintenance and repair problem.

Various barge covering systems are available to protect the cargo in a hold of a barge. Each system has disadvantages and shortfalls which leaves significant room for improvement in the field of barge covering systems, especially portable barge covering systems.

SUMMARY OF THE INVENTION

A portable barge cover for protecting cargo in a hold of a barge is provided by the present invention. The barge cover is made from several removable arched members for spanning from one side of the hold across to the other side of the hold along the length of the hold upon which several flexible sheets are placed to provide a weather tight covering over the cargo in the hold of the barge. The flexible sheets are held in place by straps which cross over the flexible sheets from one side of the hold to the other.

In a preferred form of the barge cover, the arched members are made from at least two parallel arcuate metal poles which are held fixably apart by a plurality of plates which are spaced along the length of the metal poles. In this preferred form the straps cross over the overlapping flexible sheets between the spaced apart metal poles to secure the flexible sheets to the poles and maintain the straps in a fixed location. The arched members are flexibly held to the sides of the hold for easy removal.

The barge cover flexible sheets are preferably made of reinforced polyolefin plastic. The reinforced polyolefin plastic provides a waterproof barrier. Additionally, by using several polyolefin plastic sheets that are from about 8 mils to about 10 mils thick to cover the hold, each sheet is lightweight so that only four or fewer workers are required to install or remove the flexible sheets. The polyolefin plastic is preferably polyethylene. To ensure safety to the crew and cargo as well as promote durability, the flexible sheets are flame retardant and resistant to ultraviolet light. A plurality of eyelets along the length of the flexible sheets provide a location for retaining, for example by bungee cords, the edges of the sheets to the sides of the hold. To maintain complete coverage over the cargo a flap made from the same piece of polyolefin plastic is folded over the eyelets and is extended over the sides of the hold.

In another preferred form of the barge cover, a plurality of reinforced nylon cross straps are used to provide lateral stability to the arched members. To achieve this stability, each cross strap extends from the end of one arched member and attaches to a second arched member which is spaced apart from the first arched member. The straps crisscross each other where typically four straps are used between two adjacent arched members.

In another preferred form of the barge cover an elastic undercover is used to give a smooth conformation to the flexible sheets. This undercover also avoids water collection on the flexible sheets. The elastic undercover is stretched across the arched members and attached to the sides of the hold by straps sewn integrally into the undercover. The elastic undercover is made preferably from a coated polyester mesh. A plurality of clamps are used to keep the flexible sheets stretched tightly over the arched members and the cargo free of water by securing a portion of the flexible sheet between the clamp and the side of the hold.

The barge cover of this invention has many advantages over those barge covers described in the prior art. For example, the barge cover does not require an external cover handling system to remove the covers so that a barge operator can uncover his cargo whenever and wherever he desires. Additionally, the barge cover is lightweight so that only four or fewer men are required to install and remove the covers protecting the cargo. The present barge cover is simple to implement without requiring any special tools or permanent modifications to the barges. The barge cover also can be removed easily from the barge and stored in a compact space when covering the hold is not required, and then can be easily transported by truck to a new loading point if the operator has obtained a cargo requiring a cover.

The advantages and other features of the invention will become more fully apparent from the detailed description which follows, when read in conjunction with the accompanying drawings.

DETAILED DESCRIPTION OF THE INVENTION

Figure 1:
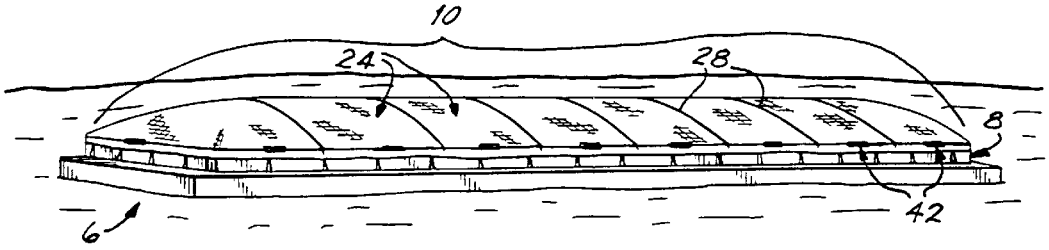
FIG. 1 is perspective view of a hopper barge with the portable barge cover in use protecting the contents of the barge.

The perspective view of FIG. 1 represents a barge 6 having a hold 8 for carrying various types of cargo such as grain, salt, finished steel or the like. The hold 8 is covered by a portable barge cover 10 that protects the cargo from contamination during storage and transport and can be removed when not required. Without the presence of a covering over the hold, the cargo is exposed to the rain, snow, dust, bird droppings and other contaminants. The portable barge cover, though not limited to any one size barge, is suited particularly for barges from about 175 feet to about 260 feet in length and from about 25 feet to about 55 feet in width. Similarly, the portable barge cover, though not limited to any one size hold, is suited particularly for holds from about 155 feet to about 220 feet in length and from about 20 feet to about 50 feet in width. In a preferred form, for a barge of about 190 to 205 feet in length and from about 30 to 40 feet in width, four flexible sheets and nine arched members are employed.

Figure 2:
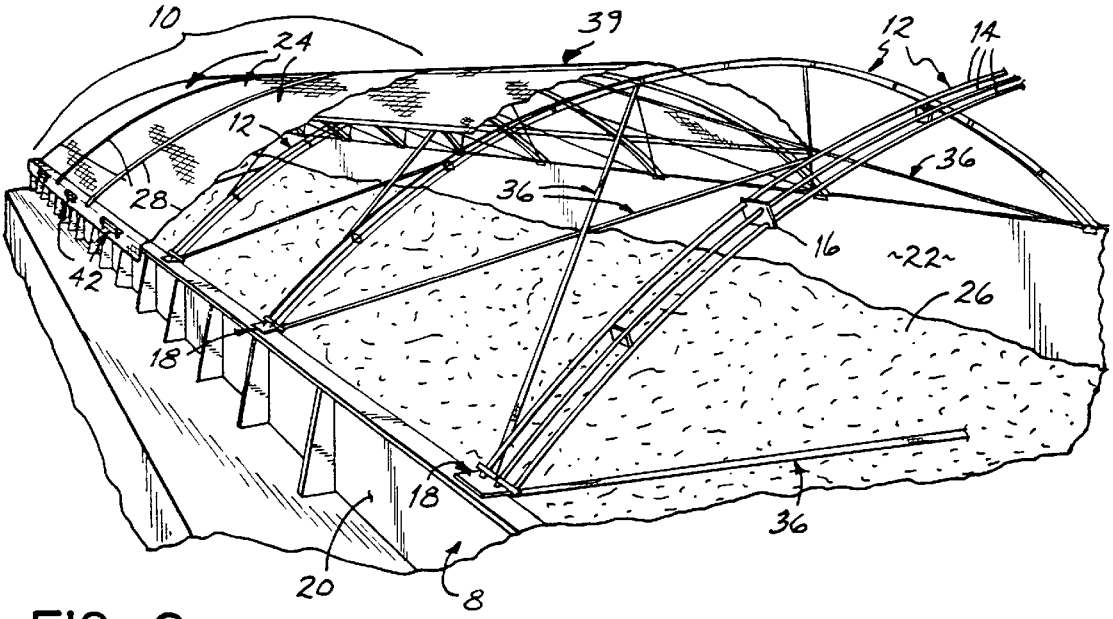
FIG. 2 is a fragmentary cut away perspective view of the portable barge cover atop a hopper barge.
Figure 3:
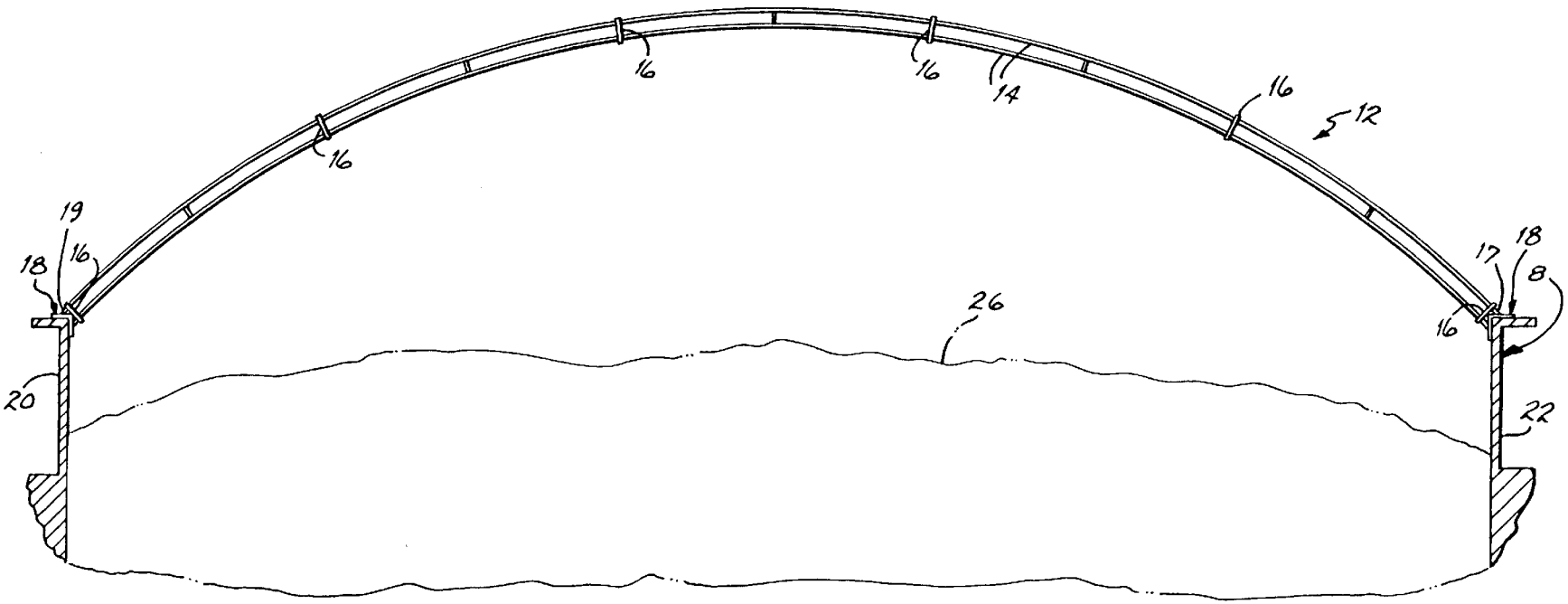
FIG. 3 is a side view of a removable arched member and a cross-sectional view of a barge upon which the arched member is mounted.
Figure 4:
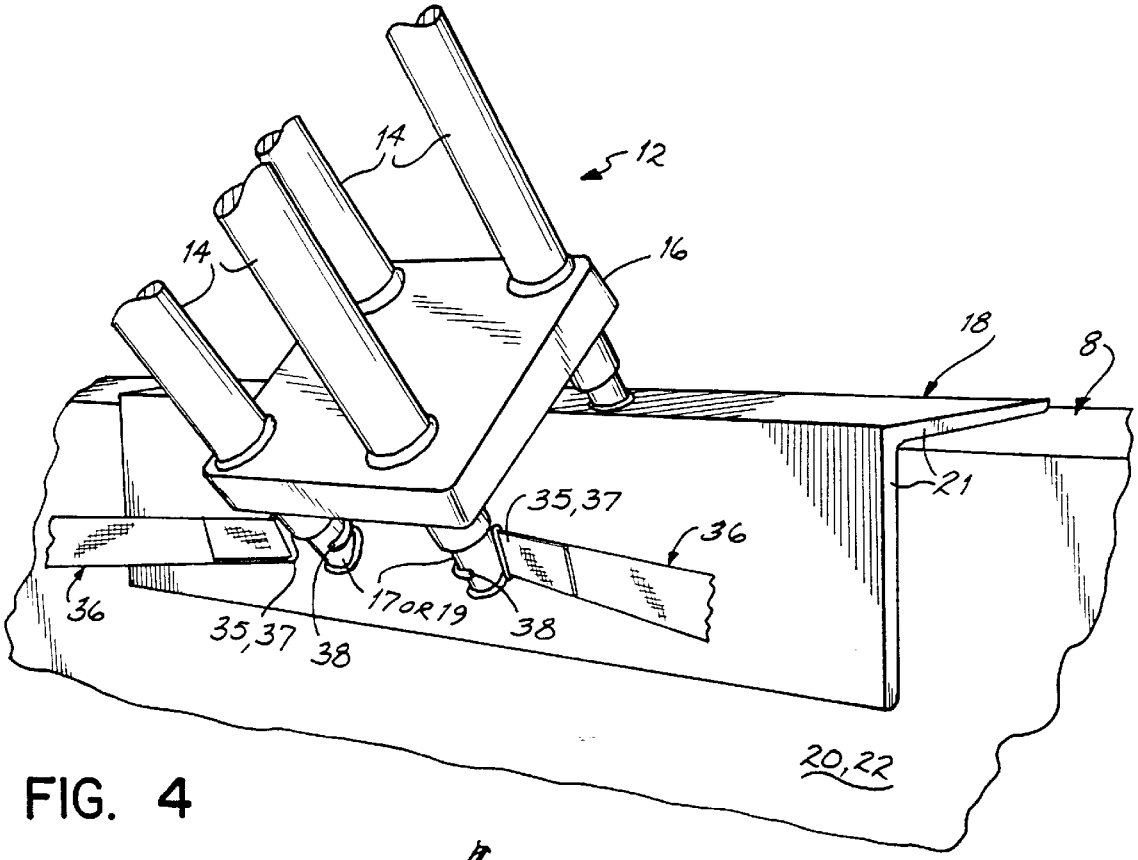
FIG. 4 is a perspective view of the end of an arched member seated against the side of the hold of the barge.

The fragmentary cut away perspective of FIG. 2 shows a plurality of removable arched members 12 for spanning from a first side 20 of the hold 8 across to an opposite second side 22 of the hold. These arched members are spaced apart along the length of the hold. At least two arched members are required for the invention where nine arched members are preferred, as stated above. FIG. 3 is a side view of a removable arched member 12. Each arched member 12 is made in five sections for portability. A plurality of substantially parallel arcuate metal poles 14 are held fixably apart by a plurality of plates 1 6 which are spaced apart along the length of the poles 14. The arched member 12 requires at least two metal poles 14, where four metal poles 14 are preferable. As shown in FIG. 4 the metal poles 14 are held fixably apart by securing the poles at approximately the corners of the plates 16. The first and second opposing ends, 17 and 19 respectively, of the metal poles 14 are attached to a length of metal angle 18 consisting of flat plates 21 that are substantially perpendicular to one another. The metal angles 18 provide a means for holding the arched members to the sides 20, 22 of the hold 8.

In its sprung state the arched member 12 is wider than the width of the hold. To place the member 12 across the hold 8, the member must be spring biased toward sides 20 and 22 of hold 8 to secure the metal angles 18 against opposing sides 20 and 22. To facilitate ease of assembly and prolonged durability the metal poles should be made of a lightweight corrosion resistant material such as aluminum or the like.

Figure 5:
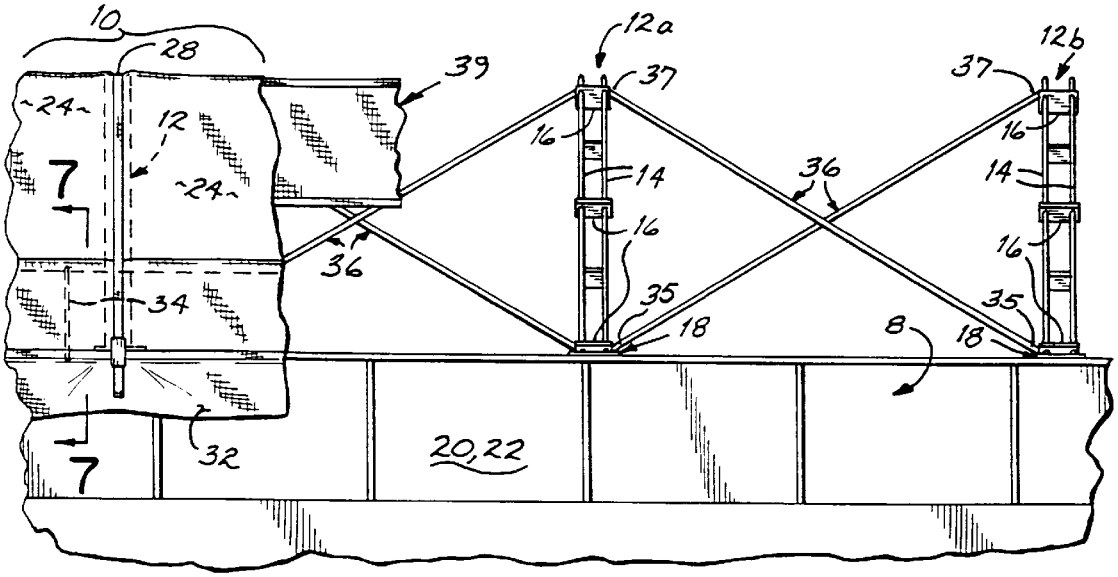
FIG. 5 is a fragmentary side view of the portable barge cover and barge.

As shown in FIG. 5 a plurality of cross straps 36 provide lateral stability for the arched members 12. A first end 35 of cross strap 36 releasably attaches to the first end 17 or to second end 19 of a metal pole 14 of first arched member 12*a* and a second end 37 of the cross strap 36 releasably attaches to a second arched member 12*b*. The second arched member 12*b* is spaced apart from the first arched member 12*a* along the length of the hold. The ends 35 and 37 of the cross straps 36 can releasably attach to the arched member 12 by any suitable means such as by hooks 38. The cross straps are preferably made of nylon webbing.

Figure 6:
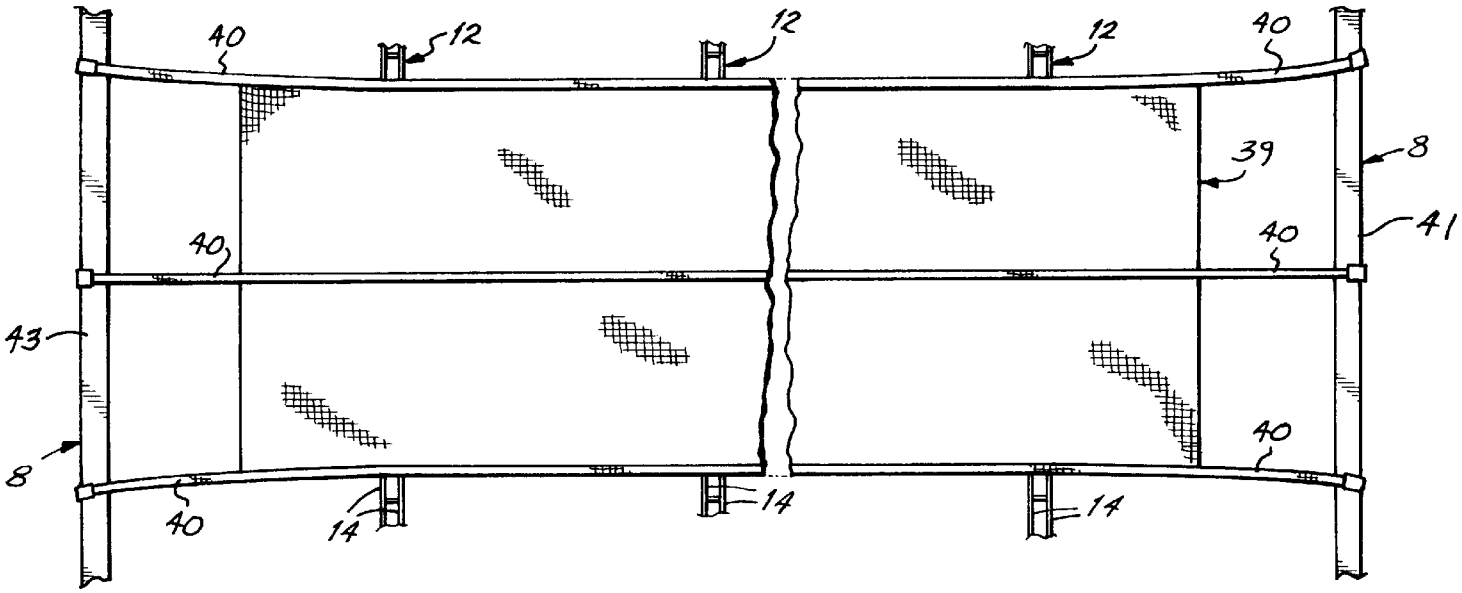
FIG. 6 is a schematic representation of the elastic undercover and the straps used to hold the undercover in place.

Also shown in FIG. 5, an elastic undercover 39 is stretched across the arched members 12. This elastic undercover gives a smooth conformation to the flexible sheets 24 (which will be discussed in more detail below) and to avoid water collection in the flexible sheets. As shown in FIG. 6, the elastic undercover 39 is detachably secured to the ends 41, 43 of the hold 8 by straps 40. The straps 40 detachably attach to the ends 41, 43 of the hold 8 by hooks or other suitable means. The elastic undercover 39 is preferably a coated polyester mesh.

As shown in FIG. 2, a plurality of flexible sheets 24 to provide protection from various contaminants are placed over the arched members 12 covering the cargo 26 carried in the hold 8 of the barge 6. Although a single flexible sheet 24 could be used in the present invention, a plurality of flexible sheets 24 is preferred, where four flexible sheets 24 are most preferred. Smaller overlapping sheets provide sufficient protection for the cargo and ensure that the sheets are light even for one to two workers to handle readily during assembly. In its preferred embodiment the flexible sheets 24 are sized to weigh no more than about 80 pounds each.

Figure 7:
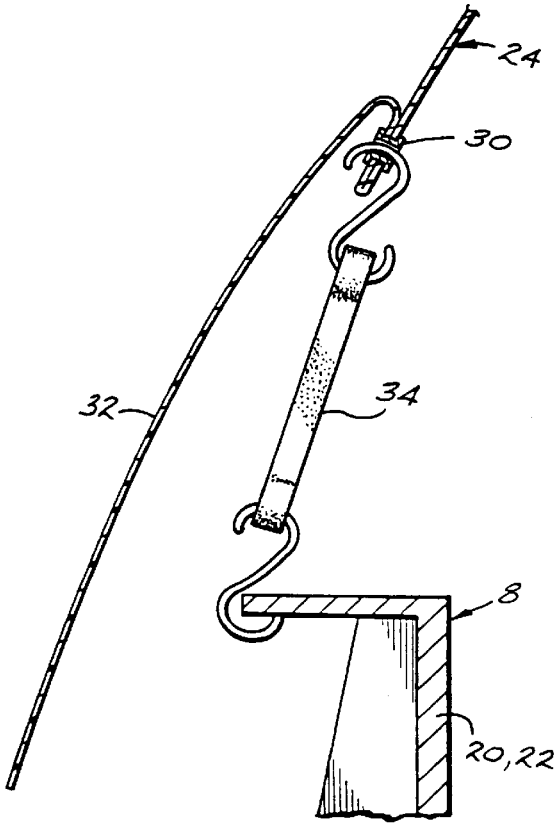
FIG. 7 is a cross-sectional detail taken along line 7—7 of FIG. 5 of the bungee cord holding down the barge cover and the flap covering the bungee cord.

As shown in FIG. 7 the flexible sheets 24 have a row of eyelets 30 running lengthwise along the edge of the flexible sheets. The eyelets 30 provide a location to flexibly retain the edges of the flexible sheets to the sides of the hold. A bungee or elastic cord 34, for example, can be used to secure the edges of the flexible sheet to the hold of the barge. To ensure complete coverage over the cargo 26, a flap 32 fashioned from the same piece of flexible sheet 24 folds over the eyelets and extends to sufficiently drape over the outside edge of the hold. The flexible sheets 24 are made of a reinforced polyolefin plastic where the preferred polyolefin plastic is polyethylene. The flexible sheets are generally from about 4 to about 20 mils thick, more preferably from about 6 to about 15 mils thick, and most preferably from about 8 to about 10 mils thick. The flexible sheets are preferably flame retardant and resistant to ultraviolet light.

As shown in FIG. 5 a plurality of straps 28 cross over the flexible sheets from the first side 20 of the hold to the second side 22 of the hold. The straps 28 cross over the overlapping flexible sheets 24 between the spaced apart metal poles 14 of the arched members 12 to secure the flexible sheets and maintain the straps in a fixed location.

Figure 8:
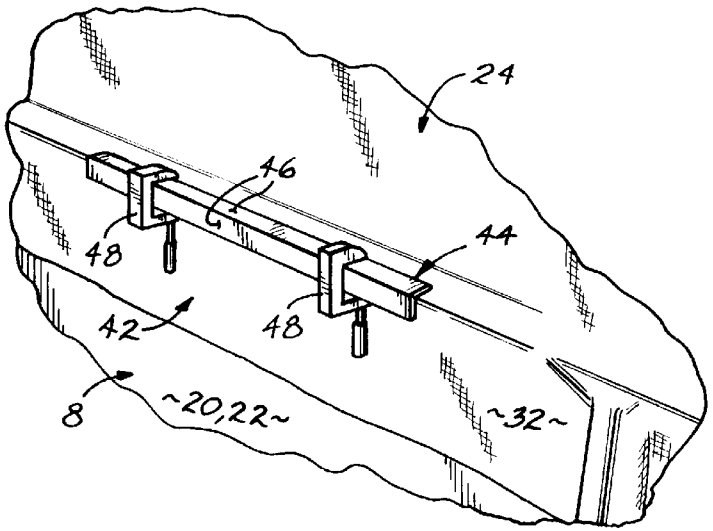
FIG. 8 is a fragmentary perspective view of one of a plurality of clamps in use along the edge of the hold of the barge to secure the edges of the barge cover.

As shown in FIG. 2 a plurality of clamps 42 keep the flexible sheets 24 stretched tightly over the arched members 24 and the cargo free of contamination. The clamp 42 secures the flap 32 of the flexible sheet 24 between the clamp 42 and the side of the barge. As shown in FIG. 8 the clamp is made from a length of metal angle 44 consisting of two plates 46 substantially perpendicular to one another and at least two C-clamps 48 to retain the flexible sheet between the metal angle 44 and the side of the barge.

Those of ordinary skill in the art will understand other benefits and embodiments of the invention in view of the above description. The invention is not limited to the above embodiments and the appended claims are to be construed to cover all equivalent structures which fall within the true scope and spirit of the invention.

What is claimed is:

1. A portable barge cover for protecting cargo in a hold of a barge comprising:

a plurality of removable arched members for spanning from a first side of the hold across to an opposite second side of the hold along the length of the hold, wherein each arched member is constructed in sections comprising:

a plurality of substantially parallel arcuate metal poles held fixably apart by a plurality of plates spaced apart along the length of the poles, and a means for flexibly holding the poles to said first and second sides of the hold, where said means is attached to a first and second opposing ends of the poles;

a plurality of flexible sheets for placement over the arched members to provide a weather tight covering over the cargo in the hold of the barge; and a plurality of straps for crossing over the flexible sheets from said first side to said second side of the hold to secure the flexible sheets in place over the arched members.

2. The barge cover of claim 1 comprising at least two arcuate metal poles spaced apart for receiving overlapping edges of adjacent flexible sheets and said straps cross over the overlapping flexible sheets between said two poles to secure the flexible sheets and maintain the straps in a fixed location.

3. The barge cover of claim 1 wherein the flexible sheets are made of a reinforced polyolefin plastic.

4. The barge cover of claim 3 wherein the polyolefin plastic is polyethylene.

5. The barge cover of claim 4 wherein the flexible sheets are from about 8 to about 10 mils thick.

6. The barge cover of claim 5 wherein the flexible sheets are flame retardant and resistant to ultraviolet light.

7. The barge cover of claim 6 wherein the flexible sheets further comprise:

a plurality of eyelets along the length of the edges of the flexible sheets to provide a location for flexibly retaining the edges to the sides of the barge; and a flap folded over the eyelets for maintaining complete coverage over the cargo in the hold.

8. The barge cover of claim 7 wherein the flexible sheets are flexibly retained along the edges by a bungee cord.

9. The barge cover of claim 1 further comprising:

a plurality of cross straps to provide lateral stability to the arched members where a first end of the strap releasably attaches to a first end of a first arched member which flexibly attaches to the side of the hold and a second end of the strap releasably attaches to a second arched member where said second arched member is spaced apart from said first arched member along the length of the hold.

10. The barge cover of claim 9 wherein the cross straps are nylon webbing.

11. A portable barge cover for protecting cargo in a hold of a barge comprising:

a plurality of removable arched members for spanning from a first side of the hold across to an opposite second side of the hold along the length of the hold;

a plurality of flexible sheets for placement over the arched members to provide a weather tight covering over the cargo in the hold of the barge;

a plurality of straps for crossing over the flexible sheets from said first side to said second side of the hold to secure the flexible sheets in place over the arched members; and an elastic undercover to give a smooth conformation of said flexible sheets over the arched members and to avoid water collection in the flexible sheets for stretching across the arched members prior to the application of the flexible sheets, said elastic undercover having straps for detachably securing the elastic undercover to the sides of the hold.

12. The barge cover of claim 11 wherein the elastic undercover is a coated polyester mesh.

13. The barge cover of claim 1 further comprising:

a plurality of clamps for keeping the flexible sheet stretched tightly over the arched members and the cargo free of water, where the clamp secures a portion of the flexible sheet between the clamp and the side of the hold.

14. The barge cover of claim 13 wherein the clamp comprises:

a length of metal angle made of two plates substantially perpendicular to one another; and a means for releasably securing the clamp to the side of the hold.

15. A portable barge cover for protecting cargo in a hold of a barge comprising:

a plurality of removable arched members for spanning from a first side of the hold across to an opposite second side of the hold along the length of the hold;

a plurality of flexible sheets for placement over the arched members to provide a weather tight covering over the cargo in the hold of the barge;

a plurality of straps for crossing the flexible sheets from said first side to said second side of the hold to secure the flexible sheets in place over the arched members;

wherein each arched member comprises at least two substantially parallel arcuate metal poles held fixably apart by a plurality of plates spaced apart along the length of the poles, wherein said poles are spaced apart for receiving overlapping edges of adjacent flexible sheets and said straps cross over the overlapping flexible sheets between said two poles to secure the flexible sheets and maintain the straps in a fixed location; and a means for flexibly holding the poles to said first and second sides of the hold, where said means is attached to a first and second opposing ends of the poles;

a plurality of reinforced cross straps to provide lateral stability to the arched members where a first end of the strap releasably attaches to a first end of a first arched member which flexibly attaches to the side of the hold and a second end of the strap releasably attaches to a second arched member where said second arched member is spaced apart from said first arched member along the length of the hold;

an elastic undercover for stretching across the arched members having straps for detachably securing the undercover to the sides of the hold;

said plurality of flexible sheets for placement over the arched members and the elastic undercover to provide a weather tight covering over the cargo in the hold of the barge; and a plurality of clamps for keeping the flexible sheets stretched tightly over the arched members and the cargo free of water, where each clamp releasably secures a portion of the flexible sheet between the clamp and the side of the hold.

16. The barge cover of claim 15 wherein the flexible sheets are made of a reinforced polyolefin plastic.

17. The barge cover of claim 16 wherein the flexible sheet is constructed of polyethylene which is from about 8 to about 10 mils thick and wherein the flexible sheet is flame retardant and resistant to ultraviolet light.

18. A portable barge cover and a barge suited for protecting cargo comprising:

a barge having a hold for carrying cargo; and a barge cover comprising a plurality of removable arched members spanning from a first side of the hold across to an opposite second side of the hold along the length of the hold, wherein each arched member is constructed in sections comprising:

a plurality of substantially parallel arcuate metal poles held fixably apart by a plurality of plates spaced apart along the length of the poles, and a means for flexibly holding the poles to said first and second sides of the hold, where said means is attached to a first and second opposing ends of the poles;

a plurality of flexible sheets placed over the arched members to provide a weather tight covering over the cargo in the hold of the barge; and a plurality of straps crossing over the flexible sheets from said first side to said second side of the hold to secure the flexible sheets in place over the arched members.

19. The barge cover of claim 18 wherein the barge is from about 175 feet to about 260 feet in length and from about 25 feet to about 55 feet in width.

20. The barge cover of claim 18 wherein the barge is from about 190 feet to about 205 feet in length and from about 30 feet to about 40 feet in width.

21. The barge cover of claim 20 having four flexible sheets and nine arched members.

22. A portable barge cover and a barge for protecting cargo comprising:

a barge having a hold for carrying cargo; and a barge cover comprising a plurality of removable arched members spanning from a first side of the hold across to an opposite second side of the hold along the length of the hold;

a plurality of flexible sheets placed over the arched members to provide a weather tight covering over the cargo in the hold of the barge;

a plurality of straps for crossing the flexible sheets from said first side to said second side of the hold to secure the flexible sheets in place over the arched members;

wherein each arched member comprises at least two substantially parallel arcuate metal poles held fixably apart by a plurality of plates spaced apart along the length of the poles, wherein said poles are spaced apart for receiving overlapping edges of adjacent flexible sheets and said straps cross over the overlapping flexible sheets between said two poles to secure the flexible sheets and maintain the straps in a fixed location; and a means for flexibly holding the poles to said first and second sides of the hold, where said means is attached to a first and second opposing ends of the poles;

a plurality of reinforced cross straps to provide lateral stability to the arched members where a first end of the strap releasably attaches to a first end of a first arched member which flexibly attaches to the side of the hold and a second end of the strap releasably attaches to a second arched member where said second arched member is spaced apart from said first arched member along the length of the hold;

an elastic undercover stretched across the arched members having straps for detachably securing the undercover to the sides of the hold;

said plurality of flexible sheets placed over the arched members and the elastic undercover to provide a weather tight covering over the cargo in the hold of the barge, a plurality of clamps for keeping the flexible sheets stretched tightly over the arched members and the cargo free of water, where each clamp releasably secures a portion of the flexible sheet between the clamp and the side of the barge.

23. The barge cover and barge of claim 22 wherein the barge is from about 175 feet to about 260 feet in length and from about 25 feet to about 55 feet in width.

24. The barge cover and barge of claim 22 wherein the barge hold is from about 190 feet to about 205 feet in length and from about 30 feet to about 40 feet in width.

25. The barge cover and barge of claim 24 having four flexible sheets and nine arched members.

* * * * *